US006393808B1

(12) United States Patent
Kallner et al.

(10) Patent No.: US 6,393,808 B1
(45) Date of Patent: May 28, 2002

(54) AUTOMATIC LABEL FILM APPLICATOR

(75) Inventors: David J. Kallner, Coral Springs; Joseph Alvarez, Ft. Lauderdale, both of FL (US)

(73) Assignee: Illinois Tool Works Inc., Glenview, IL (US)

( * ) Notice: Subject to any disclaimer, the term of this patent is extended or adjusted under 35 U.S.C. 154(b) by 65 days.

(21) Appl. No.: 09/590,999

(22) Filed: Jun. 9, 2000

(51) Int. Cl.[7] ..... B65B 53/00

(52) U.S. Cl. ..... 53/556; 53/588; 53/176; 53/135.3; 53/172

(58) Field of Search ..... 53/556, 588, 176, 53/135.3, 172

(56) References Cited

U.S. PATENT DOCUMENTS 3,216,457 A * 11/1965 Zavasnik ..... 138/111
4,722,170 A * 2/1988 Ball et al. ..... 53/556
4,723,393 A * 2/1988 Silbernagel ..... 53/556
4,905,451 A * 3/1990 Jaconelli et al. ..... 53/410
5,365,723 A * 11/1994 Ramos ..... 53/556
6,065,269 A * 5/2000 Malnati ..... 53/176

* cited by examiner

*Primary Examiner*—Rinaldi I. Rada
*Assistant Examiner*—Thanh K. Truong
(74) *Attorney, Agent, or Firm*—Schwartz & Weinrieb

(57) ABSTRACT

A label film applicator mechanism which is integrally incorporated into the overall stretch wrap film applicator system so as to be located at the same wrapping station as that of the stretch wrap film mechanism whereby the stretch wrap film can be applied to or wrapped upon, for example, the palletized load independent of the label film, however, the stretch wrap film and the label film can also be simultaneously applied to or wrapped upon, for example, the palletized load when it is desired to apply a label film to, for example, the palletized load during a predetermined portion of the stretch wrap film load wrapping cycle.

21 Claims, 5 Drawing Sheets

AUTOMATIC LABEL FILM APPLICATOR

FIELD OF THE INVENTION

The present invention relates generally to stretch wrap film applicator systems for applying or wrapping a stretch wrap film to or upon, for example, a palletized load, and more particularly to a new and improved stretch wrap film applicator system wherein a label film applicator mechanism is integrally incorporated into the overall stretch wrap film applicator system so as to be located at the same wrapping station as that of the stretch wrap film mechanism whereby the stretch wrap film can be applied to or wrapped upon, for example, the palletized load independent of the label film, however, the stretch wrap film and the label film can also be simultaneously applied to or wrapped upon, for example, the palletized load when it is desired to apply a label film to, for example, the palletized load during a predetermined portion of the stretch wrap film load wrapping cycle.

BACKGROUND OF THE INVENTION

Labels or other similar printed indicia are often desired to be placed upon stretch film wrapped loads, such as, for example, palletized loads, for various purposes, such as, for example, product identification, advertising, and the like. One conventional mode or manner for applying or placing such printed indicia or labels to or upon stretch film wrapped loads has been to print such indicia or labels directly upon the stretch wrap film prior to the application or wrapping of the stretch wrap film to or upon the loads. This mode of operation has not proven to be commercially viable, however, due to the fact that, in addition to the realization that such printing is quite costly, the printed indicia or labels tend to become distorted when the stretch wrap film is in fact stretched just prior to its application to or wrapping upon the particular load.

Another mode or manner for applying or placing printed indicia or labels to or upon stretch film wrapped loads has been to have the labels or indicia printed upon a separate film and to then apply or wrap such printed indicia or label film to or upon specific locations or regions of the load. This mode of operation, however, has likewise not proven to be especially commercially viable in view of the fact that the entire film wrapping process is more extensive from a time-cycle point of view, and therefore, commercial productivity is substantially reduced. The reason for this is that in accordance with the usual mode of operation, the load is either initially wrapped in the normal stretch wrap film and then subsequently wrapped at predetermined portions or regions thereof with the printed indicia or label film, or alternatively, the reverse wrapping procedures may be instituted, that is, the printed indicia or label film is applied to the load followed by the application or wrapping of the stretch wrap film. In accordance with either mode of operation, however, since the stretch wrap film and the indicia or label films are located at two different or separate wrapping stations, and since two separate or different wrapping operations are required, the entire wrapping process is undesirably extensive from a time-cycle operative point of view.

A need therefore exists in the art for a stretch wrap film applicator system wherein a label film applicator mechanism can be integrally incorporated into the overall stretch wrap film applicator system so as to be located at the same wrapping station as that of the stretch wrap film mechanism whereby the stretch wrap film can be applied to or wrapped upon, for example, the palletized load independent of the label film, however, the stretch wrap film and the label film can be simultaneously applied to or wrapped upon, for example, the palletized load when it is desired to apply a label film to, for example, the palletized load during a predetermined portion of the stretch wrap film load wrapping cycle.

OBJECTS OF THE INVENTION

Accordingly, it is an object of the present invention to provide a new and improved stretch wrap film wrapping system.

Another object of the present invention is to provide a new and improved stretch wrap film wrapping system which overcomes the various operational disadvantages or drawbacks characteristic of known or conventional stretch wrap film applicator systems.

An additional object of the present invention is to provide a new and improved stretch wrap film applicator system wherein the stretch wrap film and a label film can be simultaneously applied to or wrapped upon a palletized load such that the entire stretch wrap film wrapping operation, which includes the application of a label film to the palletized load, can be achieved without extending the normal stretch wrap film wrapping operation.

A further object of the present invention is to provide a new and improved stretch wrap film applicator system wherein the system comprises a stretch wrap film applicator and a label film applicator which are both located at the same load wrapping station and which is able to simultaneously apply indicia or label films to palletized loads in conjunction with the application or wrapping of stretch wrap films to or upon the palletized loads.

SUMMARY OF THE INVENTION

The foregoing and other objectives are achieved in accordance with the teachings and principles of the present invention through the provision of a new and improved stretch wrap film applicator system which comprises a label film applicator mechanism which is integrally incorporated into the overall stretch wrap film applicator system so as to be located at the same wrapping station as that of the stretch wrap film mechanism whereby the stretch wrap film can be applied to or wrapped upon, for example, the palletized load independent of the label film, however, the stretch wrap film and the label film can also be simultaneously applied to or wrapped upon, for example, the palletized load when it is desired to apply a label film to, for example, the palletized load during a predetermined portion of the stretch wrap film load wrapping cycle.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
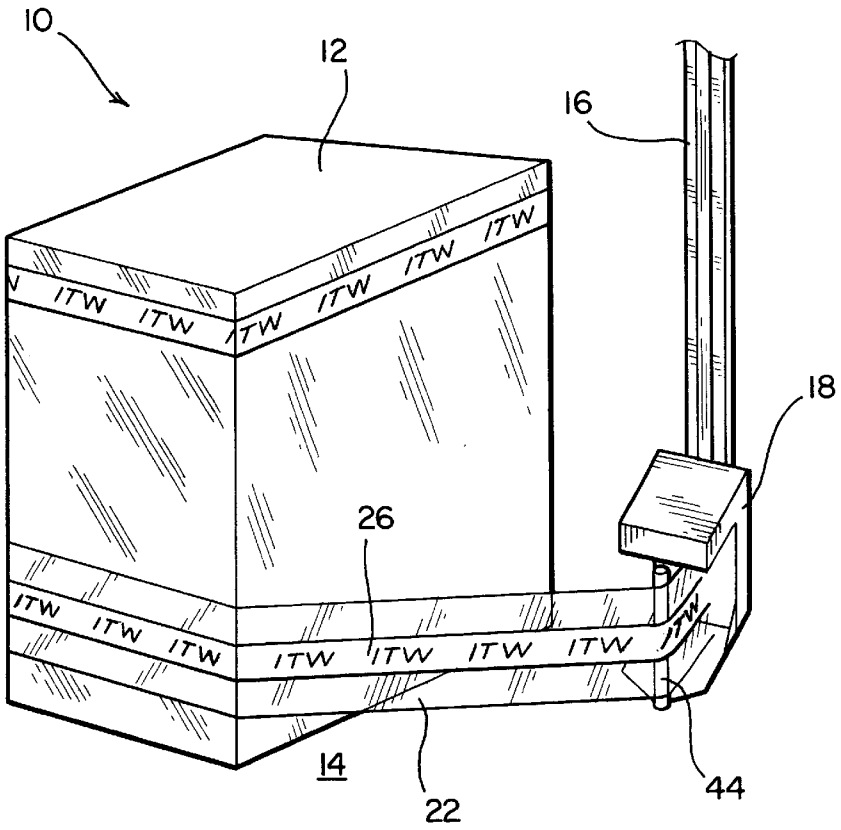
FIG. 1 is a schematic illustration of a new and improved integral stretch wrap film and label film dispensing apparatus which is constructed in accordance with the principles and teachings of the present invention and which comprises a carriage mounted upon a vertically disposed downright member so as to be vertically reciprocable thereon and wherein the vertical downright member is adapted to be rotated around a load disposed at a wrapping station such that the load can be simultaneously wrapped with both the stretch wrap film and label film during a single revolution of the intregral stretch wrap film and label film dispensing apparatus.

Referring now to the drawings, and more particularly to FIG. 1 thereof, a new and improved integral stretch wrap film and label film dispensing apparatus for simultaneously dispensing stretch wrap film and label film for wrapped disposition around a load disposed at a wrapping station is disclosed and is generally indicated by the reference character 10. A load, which may be, for example, a palletized load, is disclosed at 12 and, as is well known in the art, the load 12 is disposed at a wrapping station 14. As is also known in the art, a suitable wrapping mechanism, machine, or apparatus, not shown, includes a vertically extending downright member 16 which is adapted to be secured at its upper end to a rotating or revolving mechanism or arm, also not shown, whereby the downright member 16 is rotated or revolved around the load 12 disposed at the wrapping station 14. A carriage assembly 18 is mounted upon the vertically extending downright member 16 so as to be vertically reciprocable thereon, and the carriage assembly 18 has a supply roll of stretch wrap film 20, shown in FIG. 2, mounted thereon. As the stretch wrap film 22 from stretch wrap film supply roll 20 is dispensed or paid out while the downright member 16, and the carriage assembly 18 mounted thereon, is rotated around the load 12 disposed at the wrapping station 14, the load 12 is wrapped in stretch wrap film 22. In accordance with the unique and novel teachings of the present invention, the carriage assembly 18 also has mounted thereon a supply roll 24 of label film 26, as is also shown in FIG. 2, whereby during predetermined portions of the load wrapping cycle, only stretch wrap film 22 may be dispensed such that the load 12 is only wrapped in stretch wrap film 22, however, in an alternative manner or mode, and during other predetermined portions of the load wrapping cycle, the label film 26 can be simultaneously dispensed along with the stretch wrap film 22 as can be appreciated from FIG. 1 such that the load 12 is now simultaneously wrapped in both stretch wrap film 22 and label film 26.

With additional reference being made to FIG. 2, the dispensing flow paths of the stretch wrap film 22 and the label film 26, as dispensed from their respective supply rolls 20 and 24 mounted upon the carriage assembly 18 and as conducted toward the load 12 disposed at the wrapping station 14 and waiting to be wrapped, are disclosed and will now be described. More particularly, it is appreciated, for example, that the stretch wrap film 22 is dispensed from its supply roll 20 and is conducted around a first idler roller 28 and then between a pair of guide rollers 30 which serve to maintain the stretch wrap film properly oriented and aligned along the flow path. Downstream from the guide rollers, second and third idler rollers 32 and 34 are provided, and it is further noted that two sets of roping rollers 36 are disposed at a location or station which is interposed between the guide rollers 30 and the second idler roller 32. As is known in the art, the roping rollers 36 are actuated, or are caused to act upon the stretch wrap film 22, only at the completion of a load wrapping cycle in preparation for securing and sealing the wrapped stretch wrap film 22 upon the wrapped load 12. An infeed roller 38 is disposed downstream of the third idler roller 34, and an outfeed roller 40 is disposed downstream from the infeed roller 38. As is also known in the art, the infeed and outfeed roller 38,40 usually have different diametrical dimensions and are also rotated at different peripheral speeds whereby such characteristics enable stretching of the stretch wrap film 22 to be achieved. A strain gauge roller 42 is in turn disposed downstream from the outfeed roller 40 and is provided for detecting the pull, strain, or tension within the stretch wrap film 22 being applied to the load 12. A fourth idler roller 44 is located downstream from the strain gauge roller 42 and serves to conduct the stretch wrap film 22 toward the load 12 disposed at the wrapping station 14.

Figure 2:
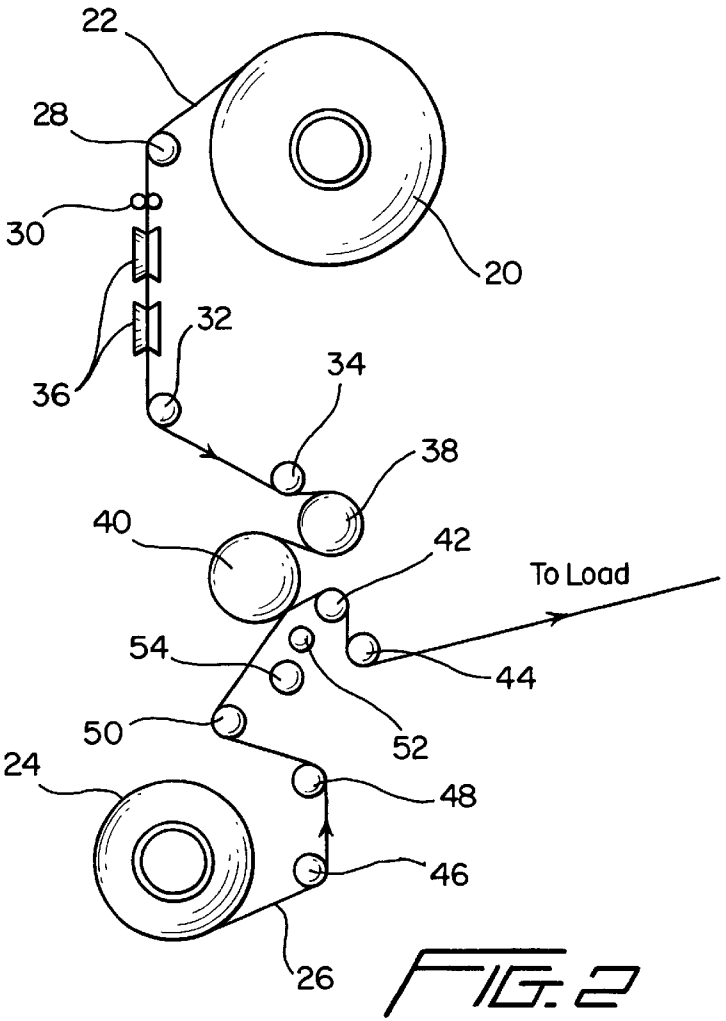
FIG. 2 is a schematic illustration of the flow paths of the stretch wrap film and the label film as such films are being dispensed and conducted toward the load being wrapped at the wrapping station shown in FIG. 1.

With reference still being made to FIG. 2, it is similarly appreciated that the label film 26 is dispensed from its supply roll 24 and is conducted around fifth, sixth, and seventh idler rollers 46,48,50. As will be subsequently disclosed in detail, the sixth idler roller 48 is movable relative to the fifth and seventh idler rollers 46 and 50 such that a predetermined amount of slack is created within the label film 26 in preparation for its dispensing along with the stretch wrap film 22 during a label application portion of the load wrapping cycle. A vacuum bar 52 is disposed downstream from the seventh idler roller 50 and is provided for retaining a forward end portion of the label film 26, which was previously severed from a rear or tail end portion of a section of the label film 26 which was previously placed upon a wrapped load during a previous label application cycle, in readiness for a new label application cycle. A placer roller 54 is also disposed downstream from the seventh idler roller 50 so as to be interposed between the seventh idler roller 50 and the vacuum bar 52 and, as will be described in further detail hereinafter, the placer roller 54 is adapted to be moved into contact with the forward end portion of the slackened label film 26, which is being retained upon the vacuum bar 52, so as to readily and effectively force the forward end portion of the label film 26 into contact with the stretch wrap film 22. AS a result of the contact of the forward end portion of the label film 26 with the stretch wrap film 22, the adhesion force established between the stretch wrap film 22 and the forward end portion of the label film 26 overcomes the label film retention force generated by the vacuum bar 52 whereby the forward end portion of the label film 26 is removed from the vacuum bar 52 and becomes adhered to the stretch wrap film 22 so as to now be conducted, in conjunction with the stretch wrap film 22, along the flow path leading toward the load 12 which is disposed at the wrapping station 14 and which is waiting to be completely wrapped.

With reference now being made to FIGS. 3–6, a detailed description of the entire label film assembly, and its component parts or subassemblies, will now be described. Initially, reference will be made to FIGS. 3 and 4 which respectively disclose the entire label film assembly 53 and a carriage subassembly thereof. The carriage subassembly is shown at 55 in FIGS. 3 and 4 and corresponds in effect to a part of the single integral carriage assembly 18 schematically illustrated in FIG. 1. More particularly, the carriage subassembly 55 is seen to comprise an upstanding mast 56 which has upper and lower support plates 58,60 integrally fixed thereto. Upper and lower mounting brackets 62,64 are adapted to be respectively fixed to the upper and lower ends of the upstanding mast 56, and the upper and lower mounting brackets 62,64 are adapted to mount the stretch wrap film supply roll 20, its associated idler rollers 28,32,34,44, infeed roller 38, and outfeed roller 40 thereon, through means of additional mounting brackets and the like, not shown, such that the entire stretch wrap film and label film dispensing subassemblies thereby form, and are mounted upon, the single integral carriage assembly 18 schematically shown in FIG. 1.

The label film supply roll 24 is adapted to be mounted upon the carriage subassembly 55 through means of a pair of upper and lower bearing chucks or end caps 66,68, and it is seen that the lower bearing chuck or end cap 68 is adapted to be rotatably fixed upon a lower bearing support 70 which, in turn, is mounted upon the lower support plate 60. A sleeve member 72 is fixedly mounted upon the upper support plate 58 and a shaft member 74 is adapted to be vertically reciprocably movable within the sleeve member 72 as can best be appreciated from FIG. 3. The upper bearing chuck or end cap 66 is secured to the lower end of shaft member 74, and a collar member 76 is fixedly secured to the upper end of the shaft member 74 so as to engage the upper end of the sleeve member 72 and thereby prevent the shaft member 74, and the upper bearing chuck or end cap 66 mounted thereon, from becoming disengaged from its mounting upon the sleeve member 72 and upper support plate 58. A sidewall portion of the sleeve member 72 is provided with a threaded aperture 78, and a set screw 80 is adapted to threadedly engage aperture 78 and extend therethrough into contact with a sidewall portion of the shaft member 74 whereby the vertical elevation of the shaft member 74 relative to the sleeve member 72 and the upper support plate 58 is adjustably positioned as the set screw 80 is tightened or loosened. In this manner, the vertical disposition of the upper chuck bearing or end cap 66 is therefore likewise adjustable so as to respectively facilitate the mounting and dismounting of a new or depleted label film supply roll 24.

Figure 3:
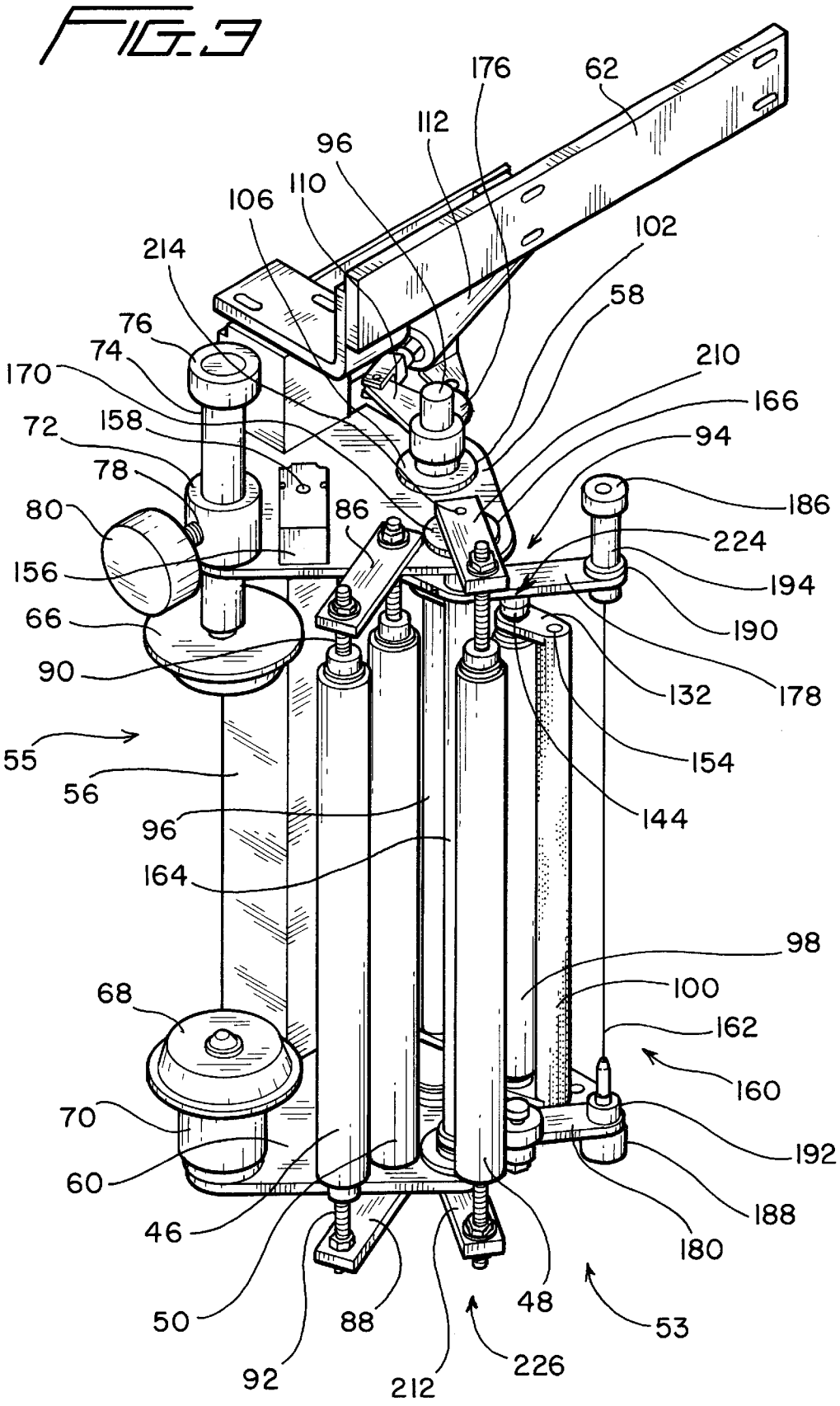
FIG. 3 is a perspective view of the new and improved label film assembly constructed in accordance with the principles and teachings of the present invention for dispensing label film in conjunction with stretch wrap film dispensed by the stretch wrap film assembly so as to form the integral stretch wrap film and label film dispensing apparatus schematically shown in FIG. 1.
Figure 4:
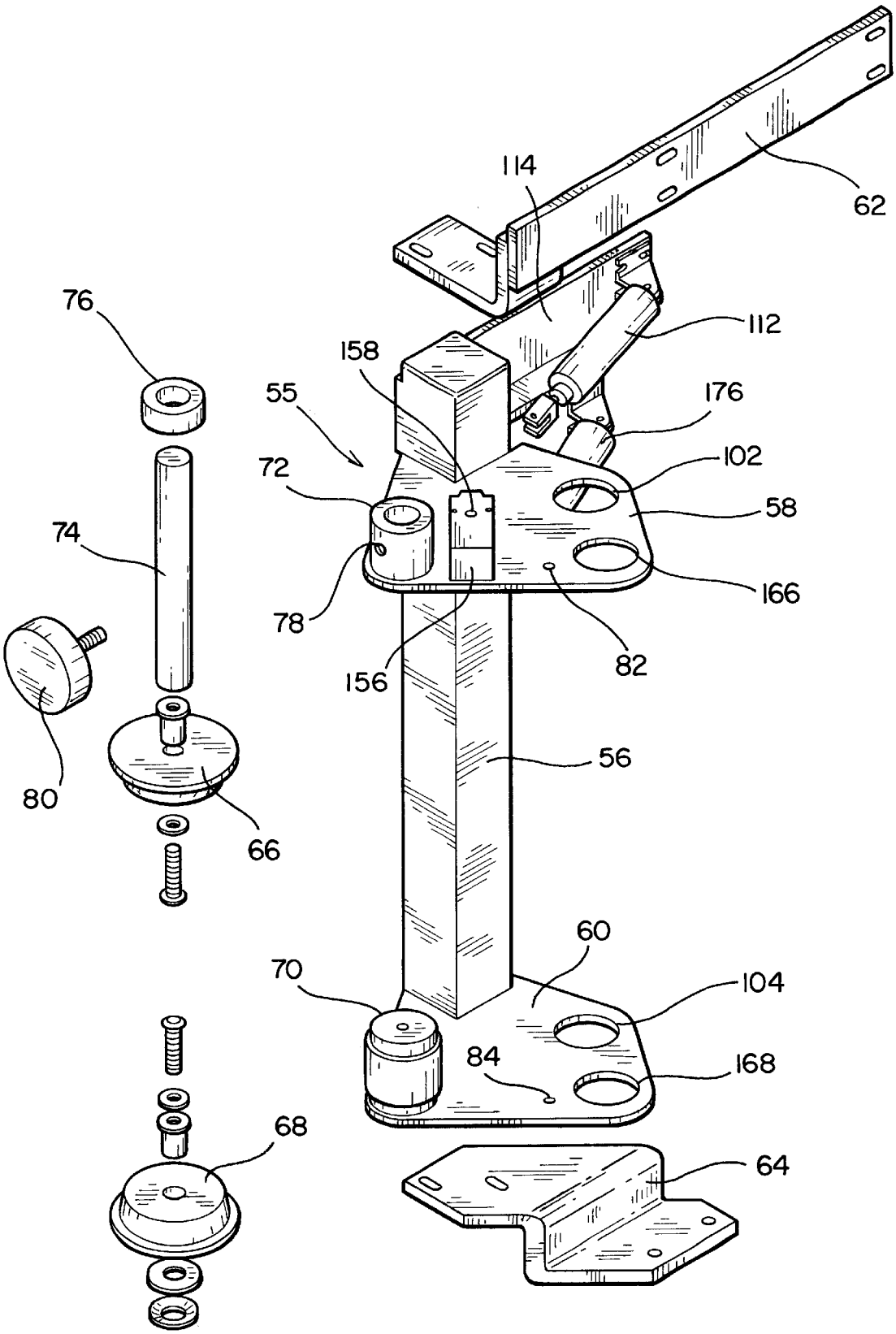
FIG. 4 is an exploded perspective view of the carriage subassembly which forms a first part of the label film assembly shown in FIG. 3.

With continued reference being made to FIG. 3, it is further seen that the fifth and seventh idler rollers 46,50 are mounted upon the carriage subassembly 55 so as to be disposed along the dispensing flow path of the label film 26, as dispensed from the label film supply roll 24, in accordance with the schematic flow diagram of FIG. 2. In order to mount the idler rollers 46,50 upon the carriage subassembly 55, each one of the upper and lower support plates 58,60 is respectively provided with an aperture 82, 84, as best seen in FIG. 4, and it is seen that the idler rollers 46,50 are in effect connected together by means of upper and lower mounting brackets 86,88 through means of suitable upper and lower bearing, nut, and bolt assemblies 90,92. More particularly, the upper and lower bearing, nut, and bolt assemblies 90,92, which are operatively connected to the idler roller 50, are fixedly mounted within the apertures 82,84 defined within upper and lower support plates 58,60 so as to fixedly mount the inner end portions of the mounting brackets 86,88 upon the upper and lower support plates 58,60, while the idler roller 46 is mounted within outer end portions of the upper and lower mounting brackets 86,88 through means its upper and lower bearing, nut, and bolt assemblies 90,92.

Figure 5:
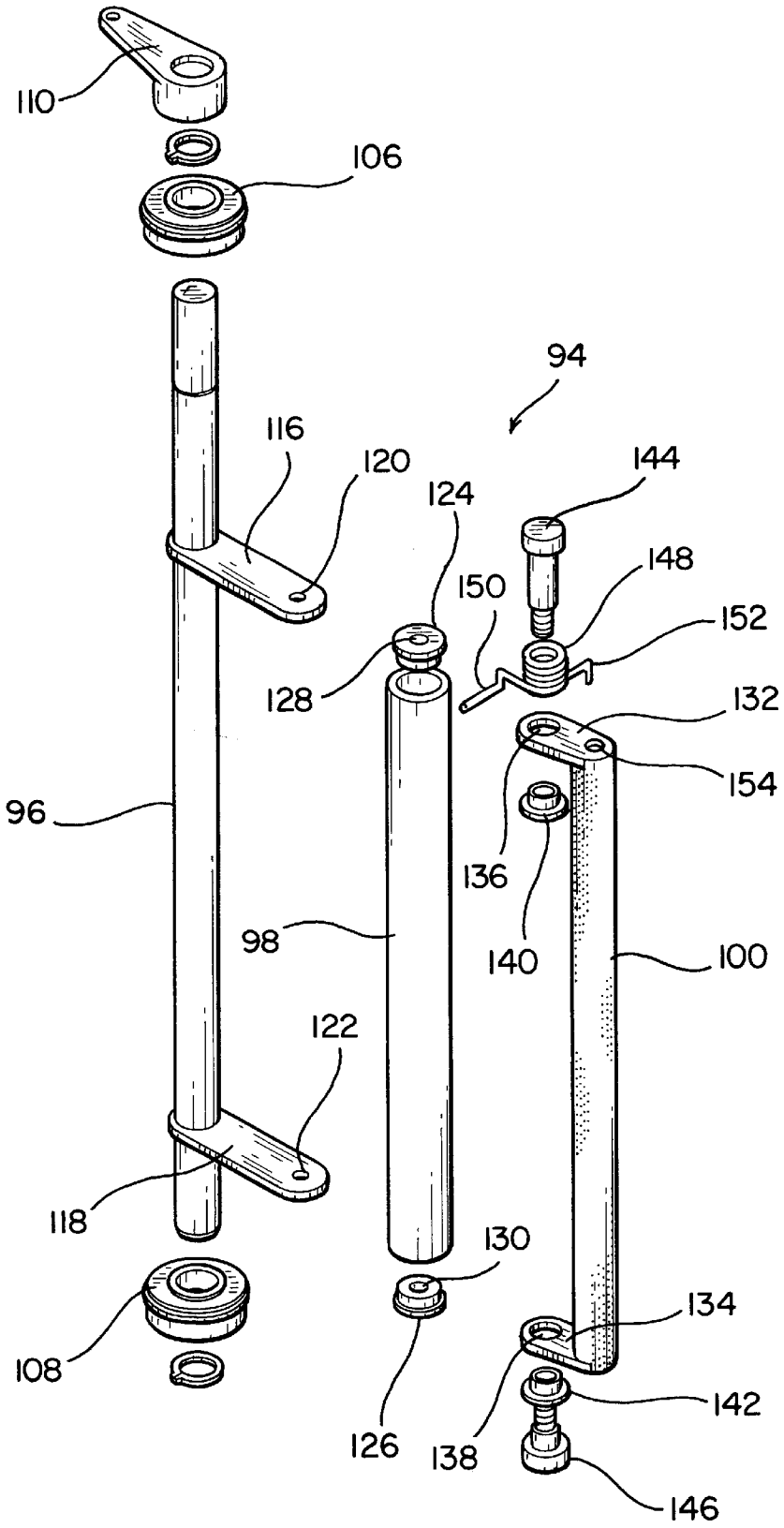
FIG. 5 is an exploded perspective view of the label film placer subassembly which forms a second part of the label film assembly shown in FIG. 3.

With reference now being made to FIGS. 3–5, FIG. 5 discloses a film placer subassembly 94 while FIG. 3 discloses the mounting and disposition of the film placer subassembly 94 upon the entire label film assembly 53. As can best be seen from FIG. 5, the film placer subassembly 94 comprises a placer roller actuating shaft 96, a placer roller 98 which corresponds to the placer roller 54 illustrated in FIG. 2, and a vacuum bar 100 which corresponds to the vacuum bar 52 also illustrated in FIG. 2. As best seen in FIG. 4, the upper and lower support plates 58,60 are respectively provided with additional apertures 102, 104, and as can best appreciated from FIGS. 3 and 5, upper and lower end portions of the placer roller actuating shaft 96 are adapted to be disposed within upper and lower bearing members 106, 108 which, in turn, are adapted to be seated within the apertures 102,104 formed within the upper and lower support plates 58,60 such that placer roller actuating shaft 96 is rotatable or pivotable with respect to the bearing members 106,108 and support plates 58,60. In order to rotatably or pivotably actuate the placer roller actuating shaft 96, one end of a lever arm 110 is adapted to be fixedly connected to the upper end portion of the placer roller actuating shaft 96 while an opposite end of the lever arm 110 is operatively connected to a piston end portion of a first pneumatic actuating cylinder 112 which is also illustrated in FIG. 4. As is also best seen in FIG. 4, actuating cylinder 112 is mounted upon a mounting bracket 114 which is fixedly secured to an upper end portion of the carriage subassembly mast 56.

With reference continuing to be made to FIG. 5, vertically spaced upper and lower mounting arms 116,118 are fixedly mounted at respective first ends thereof upon the placer roller actuating shaft 96, and opposite second ends of the mounting arms 116,118 are respectively provided with apertures 120,122. Opposite hollow ends of the placer roller 98 have bearing members 124,126 mounted therein, and the bearing members 124,126 are respectively provided with axial apertures 128,130. Accordingly, when the placer roller 98 and its associated bearing members 124,126 are mounted upon the mounting arms 116,118 of the placer roller actuating shaft 96, the placer roller 98 will be disposed between the mounting arms 116,118 with the upper bearing member 124 disposed beneath the mounting arm 116 while the lower bearing member 126 is disposed atop the mounting arm 118.

In a similar manner, vertically spaced upper and lower mounting arms 132,134 are integrally fixed at first ends thereof to the vacuum bar 100, while opposite second ends of the mounting arms 132,134 are respectively provided with through-apertures 136,138. Upper and lower bearing members 140,142 have central axial portions thereof which are adapted to project upwardly through the through-apertures 136,138 of the vacuum bar mounting arms 132, 134, and in this manner, the vacuum bar 100 is able to be mounted upon the mounting arms 116,118 of the placer roller actuating shaft 96 such that the vacuum bar 100 is able to be rotatably or pivotably moved relative to the placer roller 98. More particularly, when the vacuum bar 100 is mounted upon the mounting arms 116,118 of the placer roller actuating shaft 96, upper bearing member 140 and upper mounting arm 132 of the vacuum bar 100 will be seated atop the upper mounting arm 116 of the placer roller actuating shaft 96, while the lower bearing member 142 and the lower mounting arm 134 of the vacuum bar 100 will be disposed beneath the lower mounting arm 118 of the placer roller actuating shaft 96. Upper and lower bolt fasteners 144,146 have shank portions thereof which pass through the apertures 136,138 of the placer roller mounting arms 132, 134, the vacuum bar bearing members 140,142, the apertures 128,130 of the placer roller bearings 124,126, and the apertures 120,122 of the mounting arms 116, 118 of the placer roller actuating shaft 96 so as to secure the placer roller 98 and the vacuum bar 100 upon the mounting arms 116,118 of the placer roller actuating shaft 96. A torsion spring 148 is adapted to be secured atop the upper mounting arm 132 of the vacuum bar 100 by means of the upper bolt fastener 144 so as to be operatively associated with vacuum bar 100 for the purpose of returning the vacuum bar 100 to its original position, after the label film 26 has been cut upon completion of a label film application cycle, as will be described more in detail hereinafter. More particularly, it is seen that the torsion spring 148 comprises a first leg portion 150 which is adapted to be engaged with the upper mounting arm 116 of the placer roller actuating shaft 96, while a second leg portion 152 is adapted to be engaged with the upper mounting arm 132 of the vacuum bar 100.

In order to serve its purpose, which will become more apparent hereinafter, the vacuum bar 100 is hollow and the peripheral surface of vacuum bar 100 is provided with a multiplicity of tiny apertures, not shown. The interior of the vacuum bar 100 is fluidically connected to a vacuum hose connection port 154 which is defined within the upper end portion of the vacuum bar 100, and vacuum port 154 is adapted to be fluidically connected to a vacuum generator 156 which is mounted upon the upper support plate 58 of the carriage subassembly 55. The vacuum generator 156 is similarly provided with a vacuum port 158, and the vacuum ports 154, 158 are adapted to be fluidically connected together by means of a suitable vacuum hose, not shown, whereby ambient air is drawn through the apertures, not shown, provided within the outer peripheral surface of the vacuum bar 100 such that the vacuum bar 100 produces a vacuum effect for a purpose to be described more in detail hereinafter.

Figure 6:
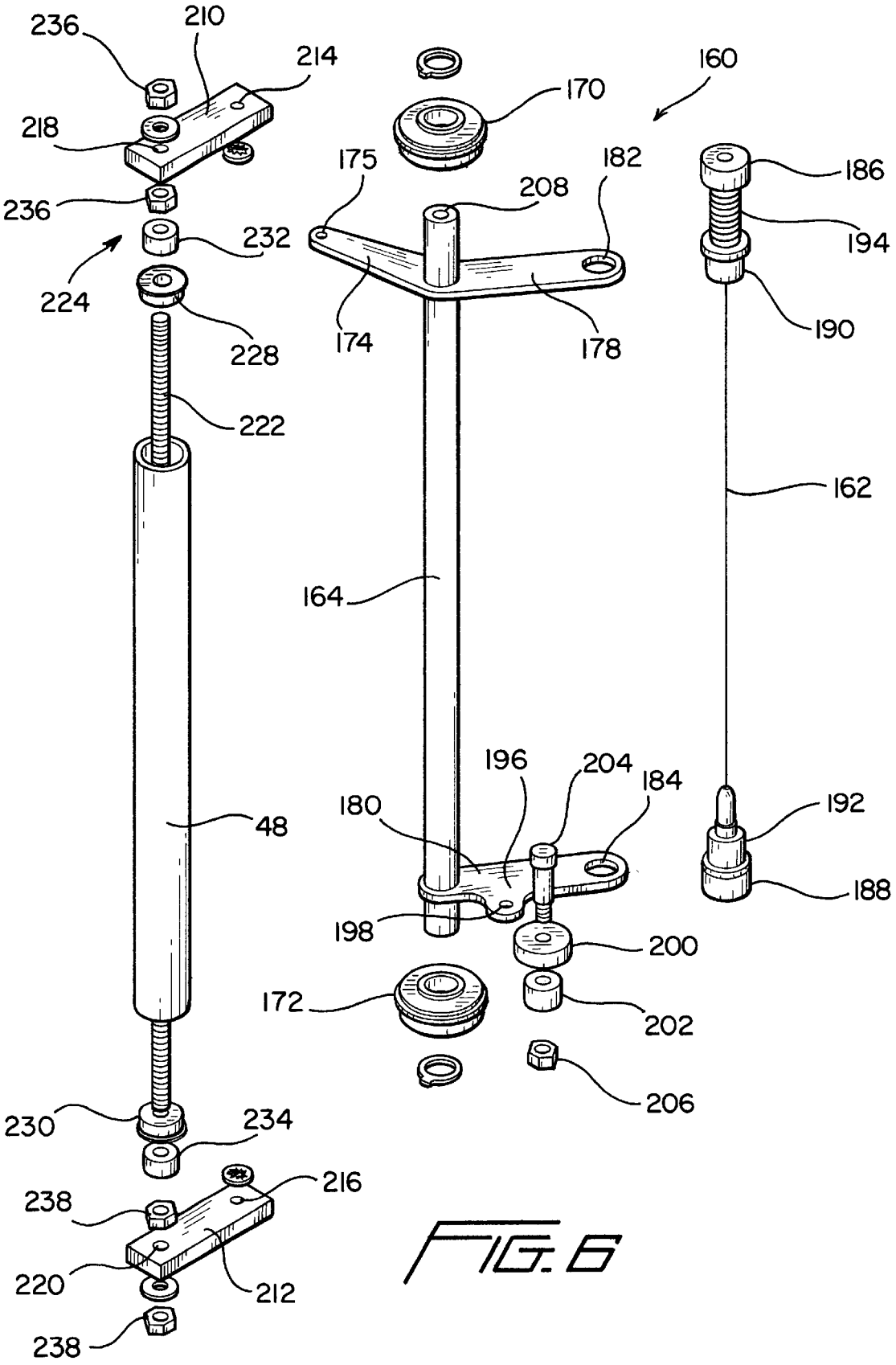
FIG. 6 is an exploded perspective view of the label film cutter wire subassembly which forms a third part of the label film assembly shown in FIG. 3.

With reference lastly being made to FIGS. 3 and 6, the cutter subassembly 160 is disclosed and is seen to comprise the idler roller 48, a cutter wire 162, and a cutter wire actuator shaft 164. As best seen in FIG. 4, the upper and lower support plates 58,60 are respectively provided with additional apertures 166,168, and as can best appreciated from FIGS. 3 and 6, upper and lower end portions of the cutter wire actuating shaft 164 are adapted to be disposed within upper and lower bearing members 170,172 which, in turn, are adapted to be seated within the apertures 166,168 formed within the upper and lower support plates 58,60 such that cutter wire actuating shaft 164 is rotatable or pivotable with respect to the bearing members 170,172 and support plates 58,60. In order to rotatably or pivotably actuate the cutter wire actuating shaft 164, one end of a lever arm 174 is fixedly connected to or mounted upon an upper end portion of the cutter wire actuating shaft 164 while an opposite end of the lever arm 174 is provided with an aperture 175 so as to be operatively connected to a piston end portion of a second pneumatic actuating cylinder 176 which is illustrated in FIGS. 3 and 4. As is also best seen in FIG. 4, actuating cylinder 176 is fixedly mounted upon a lower end portion of the mounting bracket 114 upon which actuating cylinder 112 is also mounted.

With reference continuing to be made to FIG. 6, vertically spaced upper and lower mounting arms 178,180 are fixedly mounted at respective first ends thereof upon the cutter wire actuating shaft 164, and opposite second ends of the mounting arms 178,180 are respectively provided with apertures 182,184. It is to be appreciated that upper mounting arm 178 is actually integral with lever arm 174 such that a central portion of the integral lever arm-mounting arm 174,178 is mounted upon the upper end portion of the cutter wire actuating shaft 164. The cutter wire 162 has opposite upper and lower end portions thereof mounted within suitable upper and lower wire gripper members 186,188, and each one of the wire gripper members 186,188 has respectively associated therewith a wire mounting member 190,192 by means of which the upper and lower wire gripper members 186, 188, as well as the opposite ends of the cutter wire 162, are able to be mounted within the apertures 182,184 of the upper and lower mounting arms 178,180 of the cutter wire actuating shaft 164 as may best be appreciated from FIG. 3. A coil spring member 194 is noted as being interposed between the upper wire gripper member 186 and the upper mounting member 190 and is operatively connected to the cutter wire 162 so as to impose an upwardly directed biasing force upon the cutter wire in order to maintain the cutter wire 162 in a taut state. The lower mounting arm 180 of the cutter wire actuating shaft 164 is also provided with an ear portion 196 within which an aperture 198 is defined. A bearing member 200 is adapted to be mounted atop the lower mounting arm 180 while a spacer member 202 is adapted to be mounted beneath the lower mounting arm 180. A bolt 204 is passed through the bearing member 200, the aperture 198 defined within the mounting arm 180, and the spacer member 202, and a nut 206 is threadedly engaged upon the lower end of the bolt 204 so as to fixedly secure these various components together and upon the lower mounting arm 180 of the cutter wire actuating shaft 164 as may best be appreciated from FIG. 3. The purpose of this assembly of components is to actuate the vacuum bar 100 in conjunction with the movement of the cutter wire 162 during the performance of a label film cutting portion of the label film application cycle as will be discussed more fully hereinafter.

The opposite upper and lower ends of the cutter wire actuating shaft 164 are provided with threaded apertures, only the upper one of which is illustrated at 208, in order to fixedly secure the idler roller 48 to the cutter wire actuating shaft 164 whereby the idler roller 48 will be pivotally movable along with the cutter wire 162 when the latter is actuated by means of the actuating cylinder 176 acting upon the lever arm 174 and the cutter wire actuating shaft 164. More particularly, upper and lower mounting brackets 210, 212, similar to upper and lower idler roller mounting brackets 86,88, are provided for interconnecting the idler roller 48 to the cutter wire actuating shaft 164. First inner ends of the upper and lower mounting brackets 210,212 are respectively provided with apertures 214,216 for receiving suitable threaded fasteners, not shown, for engaging the threaded apertures defined within the opposite upper and lower ends of the cutter wire actuating shaft 164, as illustrated at 208, by means of which the upper and lower mounting brackets 210,212 are secured to the opposite upper and lower ends of the cutter wire actuating shaft 164. Second outer ends of the upper and lower mounting brackets 210, 212 are similarly provided with apertures 218,220 for receiving opposite upper and lower ends of an idler roller shaft 222 coaxially disposed internally within the idler roller 48, and the idler roller 48, idler roller shaft 222, and upper and lower mounting brackets 210,212 are fixedly secured together by means of suitable upper and lower bearing, spacer, and nut assemblies 224,226 comprising upper and lower bearing members 228,230, upper and lower spacer members 232,234, pairs of upper and lower nut members 236,238.

In operation, the load 12 to be wrapped is disposed at the wrapping station 14 and is adapted to be wrapped within stretch wrap film 22 dispensed from the stretch wrap film supply roll 20. During those periods of the entire load wrapping cycle wherein the load 12 is only wrapped with stretch wrap film 22, a leading or forward end portion of the label film 26 is fixedly retained upon the vacuum bar 100 by means of the vacuum effect imposed upon the vacuum bar 100 by the vacuum generator 156 and its fluidic connection to the vacuum bar 100 by means of the aforenoted vacuum hose, not shown. When it is desired to additionally wrap the load 12 with a label film 26 in conjunction with the stretch wrap film 22, the apparatus and dispensing system, or label film assembly 53 of the present invention, permits and facilitates the simultaneous dispensing of the label film 26 along with the stretch wrap film 22. Considered from a different point of view, the present invention system or apparatus 53 permits the stretch wrap film 22 to be dispensed and wrapped around the load 12 independent of the dispensing and wrapping of the load 12 with the label film 26, whereas when desired, both the stretch wrap film 22 and the label film 26 may be simultaneously dispensed and wrapped around the particular load 12.

More particularly, then, when in fact the label film 26 is to be dispensed and wrapped around the load 12 along with the stretch wrap film 22, the apparatus or system 53 is activated in accordance with suitable electronic programming, not described herein as such is not directed toward the unique and novel attributes of the present invention, such that the pneumatic cylinder 112 is electro-pneumatically activated whereby, through means of lever arm 110, placer roller actuating shaft 96 is rotated or pivoted. As a result of the rotation or pivotal movement of the placer roller actuating shaft 96, the placer roller 98, which corresponds to the placer roller 54 illustrated in FIG. 2, and the vacuum bar 100, which corresponds to the vacuum bar 52 illustrated in FIG. 2, are both moved inwardly toward the label film 26 as may best be appreciated from FIG. 2 whereby upon contact of the placer roller 54/98 with the label film 26, and as a result of further movement of the placer roller 54/98 toward the outfeed roller 40 around which the stretch wrap film 22 is being conducted, the label film 26 is forced into contact with the stretch wrap film 22. As is known in the art, the stretch wrap film 22 and the label film 26 are each provided with suitable tackifiers whereby, for example, the films 22,26 are provided with cling sides and slip sides. Upon contact of the label film 26 with the stretch wrap film 22, the adhesion force generated between the tackified cling sides of the films 22,26 is sufficiently large and greater than the adhesion force induced upon the label film 26 by means of the vacuum bar 100 such that the leading or forward end of the label film 26 is withdrawn from the vacuum bar 52/100 whereby the label film 26 is now adhered to the stretch wrap film 22, dispensed from the label film supply roll 24, and conducted along with the stretch wrap film 22 toward the load 12. The pneumatic cylinder 112 is then activated in a reverse manner whereby, through means of the lever arm 110, placer roller actuating shaft 96 is rotated or pivoted in the reverse direction so as to move the placer roller 54/98 and the vacuum bar 52/100 away from the label film 26 so as to permit the label film 26 to be freely dispensed along with the stretch wrap film 22.

When it is desired to terminate dispensing of the label film 26 and the application of the label film 26 to the load 12 in conjunction with the stretch wrap film 22, the pneumatic cylinder 176 is activated whereby the cutter wire actuating shaft 164 is rotated or pivoted through means of the lever arm 174. As a result of the rotational or pivotal movement of the cutter wire actuating shaft 164, cutter wire 162 is moved toward the label film 26. Cutter wire 162 comprises in effect an electrical wire which becomes heated when current is conducted therethrough. Consequently, when the cutter wire 162 engages the label film 26, the cutter wire severs the label film 26 whereby the trailing or rear end portion of the label film 26 within the vicinity of the severed location continues along with the stretch wrap film 22 and is adhered to the load 12 being wrapped. As a result of the pivotal or rotational movement of the cutter wire actuating shaft 164 and the movement of the lower mounting arm 180 along therewith such that the cutter wire 162 is moved toward the label film 26 so as to sever the same, the spacer 202 secured upon the lower mounting arm 180 engages the lower mounting arm 134 of the vacuum bar 100 whereby the vacuum bar 100 is likewise forced to move toward the label film 26 independently of the placer roller 54/98. Consequently, as a result of the vacuum effect generated within the vacuum bar 100, the leading or forward end of the severed label film 26 is now able to be attracted toward and adhered upon the vacuum bar 100.

It is also to be remembered that idler roller 48 is also mounted upon the cutter wire actuating shaft 164, and consequently, when the cutter wire actuating shaft 164 is rotated or pivoted as noted, idler roller 48 will in effect be moved outwardly or toward the right as seen in FIG. 2 whereby a predetermined amount of additional label film 26 is withdrawn from the label film supply roll 24 so as to in effect create a predetermined amount of slack in the label film 26. This slack within the label film 26 permits the leading or forward end of the label film 26, which is now adhered upon the vacuum bar 100, to be easily moved toward the stretch wrap film 22, being conducted around the outfeed roller 40, by means of the placer roller 54/98 during the next label film application cycle. Upon completion of a particular label application cycle, and the severing of the label film 26 by means of the cutter wire 162, the pneumatic cylinder 176 is activated in reverse whereby the cutter wire actuating shaft 164 is pivoted or rotated in a reverse direction so as to withdraw the cutter wire 162 away from its disposition at which it engages and severs the label film 26. The idler roller 48 is also moved back to its original position so as to effectively release the slackened label film 26 in preparation for the next label film application cycle, and as a result of a similar reverse movement of the lower mounting arm 180, spacer 202 is moved away from the lower mounting arm 134 of the vacuum bar 100 so as to permit the vacuum bar 100, with the forward or leading end of the label film 26 adhered thereto, to move away from outfeed roller 40, and the stretch wrap film 22 being conducted therearound, under the influence of the spring member 148. This completes the label application cycle whereupon a new label application cycle is ready to be performed.

Thus, it may be seen that in accordance with the principles and teachings of the present invention, a labeler assembly 53 has been developed whereby a label film 26 can be simultaneously dispensed along with a stretch wrap film 22 from a single integral assembly. The assembly 53 is also operable such that the stretch wrap film 22 is able to be dispensed independently with respect to the label film 26, however, when desired, the label film 26 may be simultaneously dispensed along with the stretch wrap film 22. Still further, the single integral label film dispensing assembly can be readily incorporated within existing stretch wrap film apparatus.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. Label film applicator apparatus for use in conjunction with stretch wrap film wrapping apparatus for wrapping stretch wrap film upon a load, comprising:

a supply roll of stretch wrap film;

means for conducting stretch wrap film from said supply roll of stretch wrap film along a flow path toward a load to be wrapped within said stretch wrap film;

a supply roll of label film; and means for conducting label film, from said supply roll of label film toward the load to be wrapped within said stretch wrap film, simultaneously with said stretch wrap film being conducted toward the load to be wrapped within said stretch wrap film such that said label film and said stretch wrap film are simultaneously wrapped together upon the load in an overlapped superimposed mode.

2. The label film applicator apparatus as set forth in claim 1, wherein:

said stretch wrap film and said label film comprise tackifier constituents so as to define an adhesion force therebetween when disposed in contact with each other;

a vacuum bar disposed adjacent to said flow path of said stretch wrap film and defining a vacuum effect force for retaining a leading end portion of said label film upon said vacuum bar; and a placer roller disposed adjacent to said vacuum bar and movable from a first inoperative position to a second operative position adjacent to said flow path of said stretch wrap film so as to engage said leading end portion of said label film retained upon said vacuum bar and force said leading end portion of said label film into contact with said stretch wrap film whereby as a result of said adhesion force defined between said stretch wrap film and said label film being greater than said vacuum effect force retaining said leading end portion of said label film upon said vacuum bar, said leading end portion of said label film is removed from said vacuum bar and adhered to said stretch wrap film such that said label film is conducted along with said stretch wrap film along said flow path of said stretch wrap film toward the load.

3. The label film applicator apparatus as set forth in claim 2, further comprising:

a wire cutter mechanism disposed adjacent to said vacuum bar and movable from a first inoperative position toward a second operative position adjacent to said label film upon termination of a label film application cycle for cutting said label film into said leading end portion and a trailing end portion; and means mounted upon said wire cutter mechanism and engageable with said vacuum bar for moving said vacuum bar from a first inoperative position to a second operative position adjacent to said label film so as to attract said leading end portion of said label film onto said vacuum bar after said label film has been cut by said wire cutter mechanism.

4. The label film applicator apparatus as set forth in claim 3, wherein:

said vacuum bar is movably mounted upon said placer roller; and a spring mechanism is operatively engageable with said placer roller and said vacuum bar so as to return said vacuum bar from said second operative position to said first inoperative position upon termination of said label film application cycle.

5. The label film applicator apparatus as set forth in claim 3, wherein:

an idler roller mounted upon said wire cutter mechanism for movement against said label film in response to movement of said wire cutter mechanism from said first inoperative position to said second operative position so as to create a predetermined amount of slack within said label film for facilitating removal of said leading end portion of said label film by said placer roller from said vacuum bar and into contact with said stretch wrap film.

6. The label film applicator apparatus as set forth in claim 2, further comprising:

a first pneumatically controlled piston-cylinder mechanism operatively connected to said placer roller for moving said placer roller from said first inoperative position to said second operative position.

7. The label film applicator apparatus as set forth in claim 3, further comprising:

a second pneumatically controlled piston-cylinder mechanism operatively connected to said wire cutter mechanism for moving said wire cutter mechanism from said first inoperative position to said second operative position.

8. Stretch wrap film wrapping apparatus for wrapping stretch wrap film upon a load in accordance with a stretch wrap film wrapping cycle, comprising:

a supply roll of stretch wrap film;

means for conducting stretch wrap film from said supply roll of stretch wrap film along a flow path toward a load to be wrapped within said stretch wrap film;

a supply roll of label film; and means for cyclically conducting label film, from said supply roll of label film toward the load to be wrapped within said stretch wrap film, such that during first predetermined time periods of said stretch wrap film wrapping cycle, said means for conducting said label film from said supply roll of label film toward the load is deactivated whereby only said stretch wrap film is conducted toward and wrapped around the load, whereas during second predetermined time periods of said stretch wrap film wrapping cycle, said means for conducting said label film from said supply roll of label film toward the load is activated whereby said label film and said stretch wrap film are simultaneously conducted toward the load so as to be wrapped together upon the load in an overlapped superimposed mode.

9. The stretch wrap film wrapping apparatus as set forth in claim 8, wherein:

said stretch wrap film and said label film comprise tackifier constituents so as to define an adhesion force therebetween when disposed in contact with each other;

a vacuum bar disposed adjacent to said flow path of said stretch wrap film and defining a vacuum effect force for retaining a leading end portion of said label film upon said vacuum bar; and a placer roller disposed adjacent to said vacuum bar and movable from a first inoperative position to a second operative position adjacent to said flow path of said stretch wrap film so as to engage said leading end portion of said label film retained upon said vacuum bar and force said leading end portion of said label film into contact with said stretch wrap film whereby as a result of said adhesion force defined between said stretch wrap film and said label film being greater than said vacuum effect force retaining said leading end portion of said label film upon said vacuum bar, said leading end portion of said label film is removed from said vacuum bar and adhered to said stretch wrap film such that said label film is conducted along with said stretch wrap film along said flow path of said stretch wrap film toward the load.

10. The stretch wrap film wrapping apparatus as set forth in claim 9, further comprising:

a wire cutter mechanism disposed adjacent to said vacuum bar and movable from a first inoperative position toward a second operative position adjacent to said label film upon termination of a label film application cycle for cutting said label film into said leading end portion and a trailing end portion; and means mounted upon said wire cutter mechanism and engageable with said vacuum bar for moving said vacuum bar from a first inoperative position to a second operative position adjacent to said label film so as to attract said leading end portion of said label film onto said vacuum bar after said label film has been cut by said wire cutter mechanism.

11. The stretch wrap film wrapping apparatus as set forth in claim 10, wherein:

said vacuum bar is movably mounted upon said placer roller; and a spring mechanism is operatively engageable with said placer roller and said vacuum bar so as to return said vacuum bar from said second operative position to said first inoperative position upon termination of said label film application cycle.

12. The stretch wrap film wrapping apparatus as set forth in claim 10, wherein:

an idler roller mounted upon said wire cutter mechanism for movement against said label film in response to movement of said wire cutter mechanism from said first inoperative position to said second operative position so as to create a predetermined amount of slack within said label film for facilitating removal of said leading end portion of said label film by said placer roller from said vacuum bar and into contact with said stretch wrap film.

13. The stretch wrap film wrapping apparatus as set forth in claim 9, further comprising:

a first pneumatically controlled piston-cylinder mechanism operatively connected to said placer roller for moving said placer roller from said first inoperative position to said second operative position.

14. The stretch wrap film wrapping apparatus as set forth in claim 10, further comprising:

a second pneumatically controlled piston-cylinder mechanism operatively connected to said wire cutter mechanism for moving said wire cutter mechanism from said first inoperative position to said second operative position.

15. Stretch wrap film wrapping apparatus for wrapping stretch wrap film upon a load in accordance with a stretch wrap film wrapping cycle, comprising:

a vertical downright member adapted to be rotatable around a wrapping station at which a load to be wrapped is disposed;

a carriage vertically movable upon said vertical downright member;

a supply roll of stretch wrap film mounted upon said carriage;

means for conducting stretch wrap film from said supply roll of stretch wrap film along a flow path toward a load to be wrapped within said stretch wrap film;

a supply roll of label film mounted upon said carriage; and means for cyclically conducting label film, from said supply roll of label film toward the load to be wrapped within said stretch wrap film, such that during first predetermined time periods of said stretch wrap film wrapping cycle, said means for conducting said label film from said supply roll of label film toward the load is deactivated whereby only said stretch wrap film is conducted toward and wrapped around the load, whereas during second predetermined time periods of said stretch wrap film wrapping cycle, said means for conducting said label film from said supply roll of label film toward the load is activated whereby said label film and said stretch wrap film are simultaneously conducted toward the load so as to be wrapped together upon the load in an overlapped superimposed mode.

16. The stretch wrap film wrapping apparatus as set forth in claim 15, wherein:

said stretch wrap film and said label film comprise tackifier constituents so as to define an adhesion force therebetween when disposed in contact with each other;

a vacuum bar disposed adjacent to said flow path of said stretch wrap film and defining a vacuum effect force for retaining a leading end portion of said label film upon said vacuum bar; and a placer roller disposed adjacent to said vacuum bar and movable from a first inoperative position to a second operative position adjacent to said flow path of said stretch wrap film so as to engage said leading end portion of said label film retained upon said vacuum bar and force said leading end portion of said label film into contact with said stretch wrap film whereby as a result of said adhesion force defined between said stretch wrap film and said label film being greater than said vacuum effect force retaining said leading end portion of said label film upon said vacuum bar, said leading end portion of said label film is removed from said vacuum bar and adhered to said stretch wrap film such that said label film is conducted along with said stretch wrap film along said flow path of said stretch wrap film toward the load.

17. The stretch wrap film wrapping apparatus as set forth in claim 16, further comprising:

a wire cutter mechanism disposed adjacent to said vacuum bar and movable from a first inoperative position toward a second operative position adjacent to said label film upon termination of a label film application cycle for cutting said label film into said leading end portion and a trailing end portion; and means mounted upon said wire cutter mechanism and engageable with said vacuum bar for moving said vacuum bar from a first inoperative position to a second operative position adjacent to said label film so as to attract said leading end portion of said label film onto said vacuum bar after said label film has been cut by said wire cutter mechanism.

18. The stretch wrap film wrapping apparatus as set forth in claim 17, wherein:

said vacuum bar is movably mounted upon said placer roller; and a spring mechanism is operatively engageable with said placer roller and said vacuum bar so as to return said vacuum bar from said second operative position to said first inoperative position upon termination of said label film application cycle.

19. The stretch wrap film wrapping apparatus as set forth in claim 17, wherein:

an idler roller mounted upon said wire cutter mechanism for movement against said label film in response to movement of said wire cutter mechanism from said first inoperative position to said second operative position so as to create a predetermined amount of slack within said label film for facilitating removal of said leading end portion of said label film by said placer roller from said vacuum bar and into contact with said stretch wrap film.

20. The stretch wrap film wrapping apparatus as set forth in claim 16, further comprising:

a first pneumatically controlled piston-cylinder mechanism operatively connected to said placer roller for moving said placer roller from said first inoperative position to said second operative position.

21. The stretch wrap film wrapping apparatus as set forth in claim 17, further comprising:

a second pneumatically controlled piston-cylinder mechanism operatively connected to said wire cutter mechanism for moving said wire cutter mechanism from said first inoperative position to said second operative position.

* * * * *